US006719172B2

(12) United States Patent
Slewidge

(10) Patent No.: US 6,719,172 B2
(45) Date of Patent: Apr. 13, 2004

(54) PEPPER AGENT SYSTEM

(75) Inventor: Kenneth Thomas Slewidge, Sault St. Marie (CA)

(73) Assignee: Summithood Enterprises, LLC, Bloomfield Hills, MI (US)

( * ) Notice: Subject to any disclaimer, the term of this patent is extended or adjusted under 35 U.S.C. 154(b) by 0 days.

(21) Appl. No.: 10/455,860

(22) Filed: Jun. 6, 2003

(65) Prior Publication Data

US 2003/0192908 A1 Oct. 16, 2003

Related U.S. Application Data

(62) Division of application No. 10/116,219, filed on Apr. 4, 2002.

(60) Provisional application No. 60/281,957, filed on Apr. 6, 2001.

(51) Int. Cl.[7] ..... B65D 35/28

(52) U.S. Cl. ..... 222/81; 222/82; 222/83.5; 222/86; 222/87; 222/103; 222/107

(58) Field of Search ..... 222/81, 82, 83.5, 222/85, 86, 87, 92–94, 95, 103, 107, 683

(56) References Cited

U.S. PATENT DOCUMENTS

| | | | | | |
|---|---|---|---|---|---|
| 1,948,306 | A | * | 2/1934 | Meurer | 222/82 |
| 3,856,142 | A | * | 12/1974 | Vessalo | 206/530 |
| 3,881,634 | A | * | 5/1975 | Thrun | 222/3 |
| 4,241,850 | A | * | 12/1980 | Speer et al. | 222/82 |
| 4,275,820 | A | * | 6/1981 | LeBlond | 222/3 |
| 4,342,395 | A | * | 8/1982 | Brown | 206/530 |
| 5,011,044 | A | * | 4/1991 | Brown | 222/78 |

* cited by examiner

*Primary Examiner*—Kenneth Bomberg
(74) *Attorney, Agent, or Firm*—Howard & Howard

(57) ABSTRACT

A dispenser for releasing a debilitating substance into a user's hand comprises an outer layer defining a cavity therein wherein the outer layer further defines a plurality of holes therethrough communicating the cavity with an exterior of said dispenser. At least one sharp projection extends from the outer layer into the cavity. A pouch is positioned within the cavity proximate to the at least one sharp projection wherein the pouch contains a debilitating substance.

5 Claims, 2 Drawing Sheets

PEPPER AGENT SYSTEM

CROSS REFERENCE TO RELATED APPLICATIONS

This application is a divisional application of U.S. patent application Ser. No. 10/116,219 filed Apr. 4, 2002 which claims the benefit of U.S. Provisional Patent Application Ser. No. 60/281,957, filed Apr. 6, 2001.

BACKGROUND OF THE INVENTION

The present invention relates to methods of self-defense in general and in particular to methods and articles for dispensing and applying a debilitating substance to a person that is desired to be subdued.

There are any many self-defense related articles known in the art. For example, U.S. Pat. No. 6,135,321 to Hippensteel discloses a self-defense ring that has a cavity and a spray orifice communicating with the cavity. There includes a canister that is within the cavity that contains a pressurized substance that is sprayed through an orifice once a triggering action is taken. U.S. Pat. No. 6,050,454 to Ludaescher also discloses a non-lethal fluid delivery device. The device includes a replaceable pressurized canister holding a fluid, such as pepper spray that discharges an atomized mist when activated. U.S. Pat. No. 5,943,701 to Seats discloses a combined hand glove and aerosol repellant device. A small cylindrical canister of an aerosol repellant is held in a glove and is worn by a person for protection against assaults. The repellant canister dispenses an aerosol to stop a would be attacker.

As can be seen from the above, it is known in the art to utilize an aerosol to dispense a substance, such as pepper spray or mace to disable a would-be attacker. The aerosol dispensing of such a substance has several detriments. A defender utilizing an aerosol must receive proper training and have the necessary manual dexterity to effectively operate the canister. To prevent accidental deployment, existing canisters employ a lockable trigger or include some other safety mechanism. These safety mechanisms must be disengaged to gain access to the trigger. Once the canister has been placed in a functional mode, it must then be raised, aimed, and discharged at the attacker. These tasks must be accomplished in a quick an efficient manner within the timeframe that the attacker poses an imminent threat to when the attacker actually begins an attack on the defender. Ideally, this process is best executed so that the defender is ready to discharge the canister before the attacker decides to strike. Under an escalating violent situation, when emotions and stress are rapidly increasing, these tasks become increasingly more demanding than in a practice atmosphere, and increasing the chances of the defender forgetting or unintentionally omitting one of the preparatory steps to use of the canister.

One of the major shortcomings of using aerosol canisters includes the possibility of cross-contamination of the spray striking an innocent bystander, or even the defender if the canister is not properly aimed. Use of an aerosol container also requires that a distance between the would-be attacker be maintained to effectively deploy such an aerosol system. The possibility of missing is increased with the speed at which the attack or altercation develops and the readiness of the defender. In a close quarter situation, an aerosol deployment of a substance provides the chance for an attacker to remove the canister from the user's person and thereby prevent deployment, and as stated above, increases the chance of cross-contamination. Further, in an outdoors situation, the prevailing weather conditions can have a detrimental effect on the use of the canister. These conditions include the possibility that a wind can cause the aerosol spray can be diverted to an innocent bystander, or in some instances even back to the defender without affecting the attacker at all.

Therefore, it would be advantageous to develop a self-defense system that would apply a debilitating substance using a non-aerosol delivery. A non-aerosol method of delivery should provide for a safer deployment by a defender against an attacker. The manner of delivery should minimize the potential of cross-contamination so those individuals who are in proximity of the attack and who might suffer from medical conditions are not adversely exposed to the dangers of the debilitating substance. Non-aerosol deployment also has the advantage of not being as adversely affected by poor weather conditions such as wind or humidity. Such a system would allow for close range deployment without the risk of cross-contamination, as well as provide a more subtle and inconspicuous deployment.

SUMMARY OF THE INVENTION

One aspect of the present invention is a dispenser for releasing a debilitating substance into a user's hand. The dispenser comprises an outer layer defining a cavity therein. The outer layer further defines a plurality of holes therethrough communicating the cavity with an exterior of said dispenser. At least one sharp projection extends from the outer layer into the cavity. A pouch is positioned within the cavity proximate to the at least one sharp projection wherein the pouch contains a debilitating substance.

Another aspect of the present invention is a method for the deployment of a non-aerosol debilitating substance comprising the steps of placing a delivery apparatus in the hand of a user. The user then releases a debilitating substance from the delivery apparatus into the user's hand, and then applying the user's hand containing the debilitating substance to the facial or other bodily region of a recipient to be debilitated.

These and other advantages of the invention will be further understood and appreciated by those skilled in the art by reference to the following written specification, claims and appended drawings.

DETAILED DESCRIPTION OF THE PREFERRED EMBODIMENT

Figure 3:
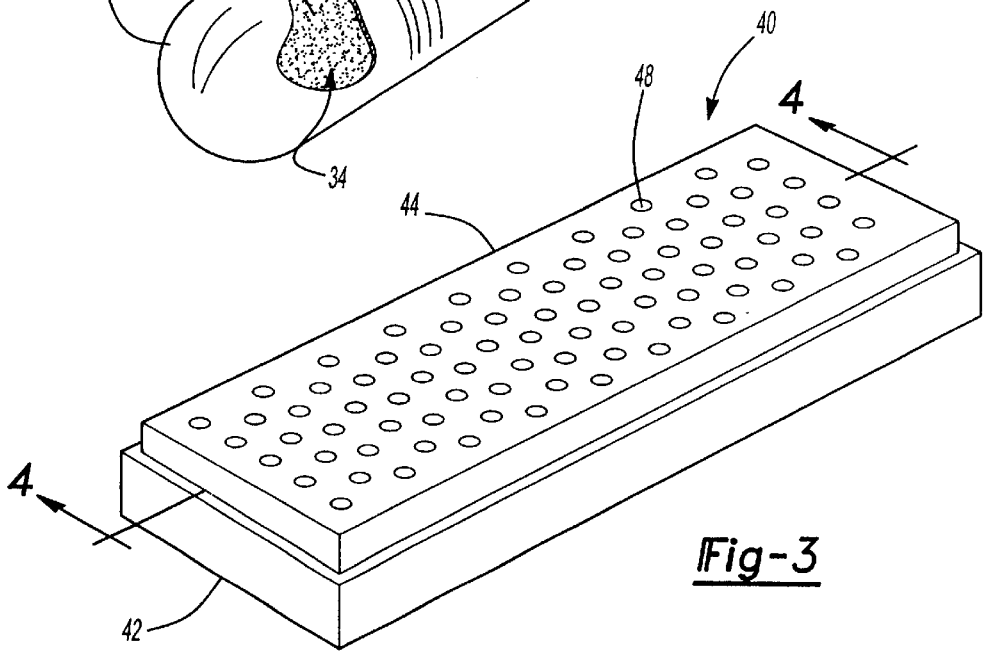
FIG. 3 is a perspective view of a plunger type delivery apparatus for use by the process of the present invention.
Figure 4:
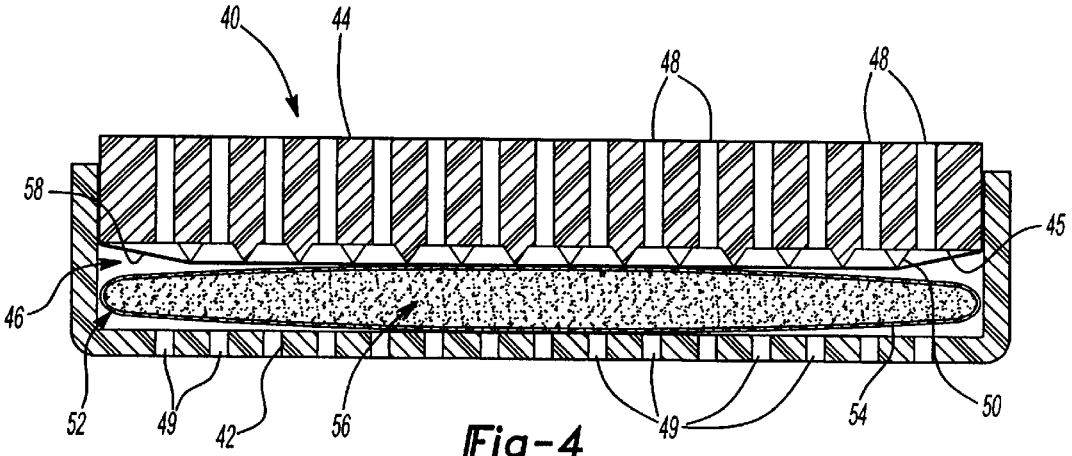
FIG. 4 is a cross-sectional view of the plunger type delivery apparatus of FIG. 3 taken along the line 4—4.
Figure 5:
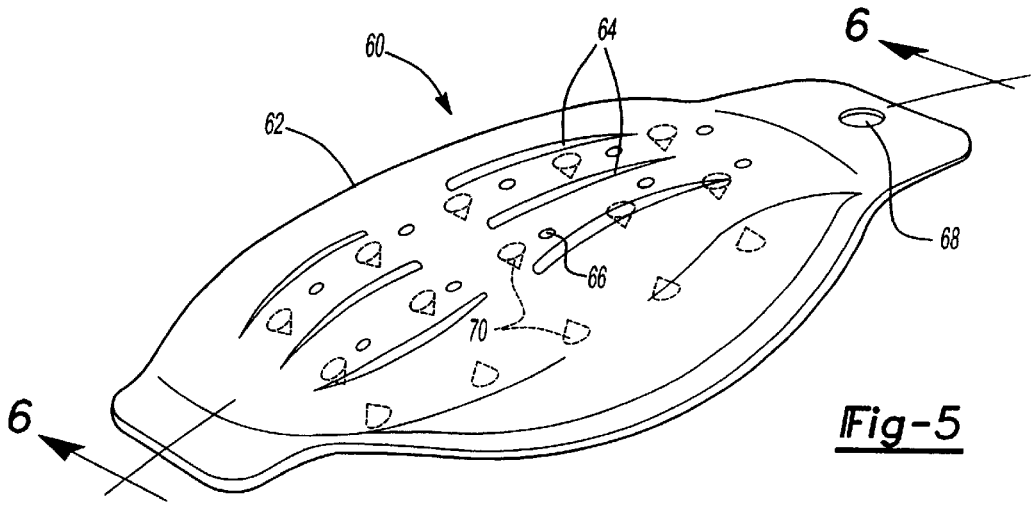
FIG. 5 is a perspective view of a squeezable delivery apparatus for use by the process of the present invention.
Figure 6:
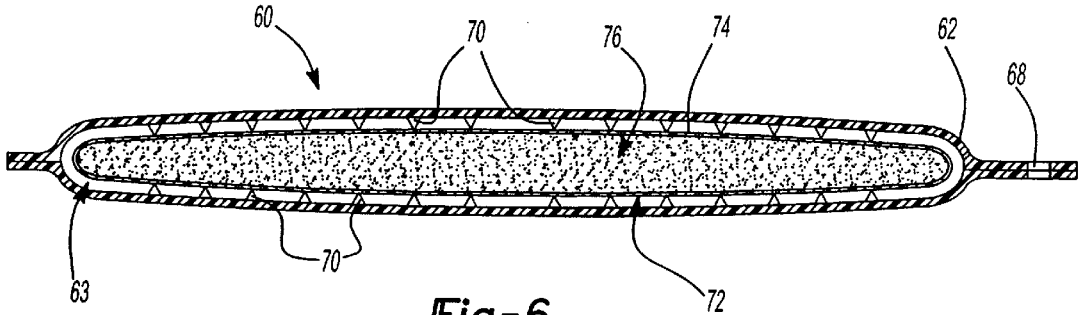
FIG. 6 is a cross-sectional view of the squeezable deliver apparatus of FIG. 5 taken along the line 6—6.

For purposes of description herein, the terms "upper", "lower", "left", "rear", "right", "front", "vertical", "horizontal", and derivatives thereof shall relate to the invention as oriented in FIG. 3. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
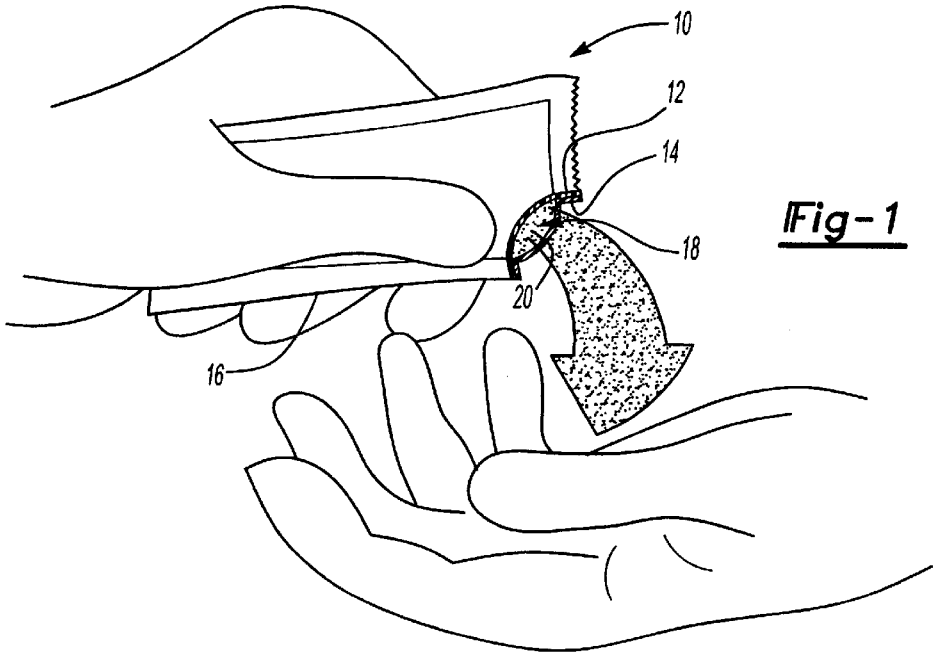
FIG. 1 is a perspective view of a delivery apparatus for use to deliver a self-defense debilitating substance according to one embodiment of the present invention.

Turning to the drawings, FIG. 1 shows a defensive substance delivery packet 10, which is one of the preferred embodiments of the present invention and illustrates its various components.

The defensive substance delivery packet 10 illustrated in FIG. 1 includes first and a second outer foil or plastic layers 12, 14 which are joined about their respective edges to form a packet 16 defining an inner compartment area 18 in which a debilitating substance 20 is stored. The two layers 12, 14 forming packet 16 may be formed of two sheets that are easily opened by a user, but sufficiently durable to prevent inadvertent bursting when carried during everyday use. In use, packet 10 may be squeezed in the palm of a user thereby causing the outer layers 12, 14 to rupture and thereby dispense the defensive substance 20 onto the user's hand or glove. The user may then use his hand or glove to apply the substance to the facial or other bodily region of a would be recipient.

The method to use the defensive substance delivery packet 10 includes deploying the debilitating substance 20 from packet 10 in a non-aerosol manner. The user releases the debilitating substance 20 into his or her hand or glove from a delivery apparatus such as packet 10 and then applying with the user's hand or glove the debilitating substance 20 to the facial or other bodily region of an attacker. Packet 10 can be ripped open or alternatively caused to rupture to release the debilitating substance 20. Packet 10 can be carried on the user directly or in a protective hard shell case, in a pouch that is affixed to a belt, on an arm or wrist band, attached to clothing or footwear, or on a necklace, bracelet or key chain. Generally, the packet can be carried in a multiple number of convenient places so the user has quick access in an emergency situation without experiencing the discomfort associated with a rigid pressurized aerosol container.

The debilitating substance 20 may include any number of known compounds in a gel, creme, paste, liquid or any other like form. Some of the known debilitating substances 20 include but are not limited to: pepper products or capsaicin; chloracetophenone or mace; orthochlorobenzalmalonitrile or tear gas; capsaicin or oleoresin capsicum also another term associated with pepper products. The user's hand or glove can dispense the substances after release from any number of alternate delivery apparatuses, which are discussed in more detail below.

Figure 2:
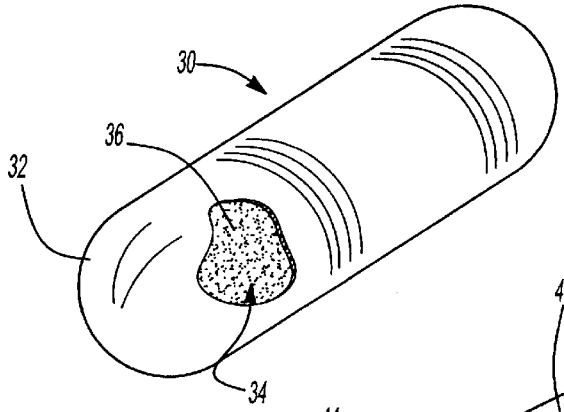
FIG. 2 is a perspective view of a second embodiment of a delivery apparatus for use by the process of the present invention.

With reference to FIG. 2, an alternate packaging concept is shown in capsule 30 that can also be utilized to deploy a debilitating substance. The capsule 30 generally include an outer layer 30 which can be formed of any suitable material such as that utilized for paintballs and the like such as polyoxyalkylene glycol gelatin capsules. The outer layer 32 defines an inner volume 34 in which there is stored a debilitating substance 36 such as any of the aforementioned products. The capsule 30 can be crushed within the user's hand to rupture the capsule 30 to thereby release the debilitating substance 36 into a hand or glove, and as above apply it to the facial region of a would be attacker or person to be subdued. Again, as with packet 10, the capsules 30 can be directly stored on the user or stored in a hard protective shell case, in a pouch affixed to a belt, arm or wrist band, or stored within a necklace or key chain.

FIG. 3 illustrates a substance dispenser 40 for delivering a debilitating substance to a user's hand. Dispenser 40 includes an outer housing 42 which defines a cavity 46 in which a capsule or pouch 52 containing a debilitating substance 56 is positioned. A plunger 44 having one or more sharp projections 50 extending from a distal end 45 is at least partially engaged in cavity 46 and slidable therein. Plunger 44 further defines a plurality of holes 48 therethrough and in communication with interior cavity 46. When the plunger 44 is depressed, the sharp projections 50 pierce and applied to the outer layer 62. Outer plastic layer 62 further includes on an interior surface, piercing elements 70 that have a sharp end directed at capsule 72.

When pressure, such as that developed by the squeezing of the user's hand therearound, is applied to the outer layer 62, the piercing elements 70 pierce outer layer of capsule 72 thereby causing capsule 72 to rupture under application of further pressure. The debilitating substance 76 that is housed within capsule 72 thereby escapes through the slots 64 or holes 66 as further pressure is applied to outer layer 62.

As with previous embodiments, the apparatus 60 may be carried by the user directly or within a secondary container. Outer layer 62 can also have a region defining a hole 68 therethrough so that apparatus 60 can be placed on a key chain or necklace or other such device for convenient deployment into the hand of a user. As with previous embodiments, once the debilitating substance 76 is deployed into the hand or glove of a user, the user can then apply the substance to the facial or other bodily region of a would be recipient using his or her hand or glove.

In the foregoing description those skilled in the art will readily appreciate that modifications may be made to the invention without departing from the concepts disclosed herein. Such modifications are to be considered as included in the following claims, unless these claims expressly state otherwise.

I claim:

1. A dispenser for releasing a debilitating substance into a user's hand, said dispenser comprising:

an outer layer defining a cavity therein, said outer layer being flexible and further defining a plurality of holes therethrough communicating said cavity with an exterior of said dispenser;

at least one sharp projection extending from said outer layer into said cavity; and a pouch positioned within said cavity proximate to said at least one sharp projection, said pouch containing a debilitating substance.

2. A dispenser according to claim 1 wherein said pouch is a capsule having a rupturable covering in which said debilitating substance is contained.

3. A dispenser according to claim 2 said pouch is a packet having a first and second layer joined about their respective edges and defining an inner compartment wherein said debilitating substance is contained in said inner compartment.

4. A dispenser according to claim 1 wherein said debilitating substance is selected from a group comprising: capsaicin, oleoresin capsicum, chloracetophenone, and orthochlorobenzalmalonitrile.

5. A dispenser according to claim 1 wherein said debilitating substance is in a form selected from a group comprising: gel, creme, paste, and liquid.

* * * * *